US010563363B2

(12) United States Patent
Barimani et al.

(10) Patent No.: US 10,563,363 B2
(45) Date of Patent: Feb. 18, 2020

(54) SCRAPER BAR FOR A SCRAPER BLADE OF A ROAD MILLING MACHINE

(71) Applicants: Wirtgen GmbH, Windhagen (DE); BETEK GmbH & Co. KG, Aichhalden (DE)

(72) Inventors: Cyrus Barimani, Königswinter (DE); Thomas Lehnert, Oberraden (DE); Andreas Salz, Neustadt (DE); Heiko Friederichs, Aichhalden-Rötenberg (DE); Andreas Rapp, Oberndorf-Boll (DE); Simon Krämer, Hofstetten (DE); Ulrich Krämer, Wolfach (DE)

(73) Assignees: Wirtgen GmbH (DE); Betek GmbH & Co. KG (DE)

( * ) Notice: Subject to any disclaimer, the term of this patent is extended or adjusted under 35 U.S.C. 154(b) by 0 days.

(21) Appl. No.: 16/043,198

(22) Filed: Jul. 24, 2018

(65) Prior Publication Data

US 2019/0055701 A1 Feb. 21, 2019

(30) Foreign Application Priority Data

Jul. 25, 2017 (DE) ..... 10 2017 116 757

(51) Int. Cl.
*E01C 23/12* (2006.01)
*E01C 23/088* (2006.01)
*E02F 3/815* (2006.01)

(52) U.S. Cl.
CPC ..... *E01C 23/121* (2013.01); *E01C 23/088* (2013.01); *E01C 23/127* (2013.01); *E02F 3/8152* (2013.01)

(58) Field of Classification Search
CPC ..... E02F 9/2808; E02F 9/28; E02F 9/2883; E02F 3/8152; E02F 9/2816; E02F 9/2825; E02F 9/2858; E01C 23/088; E01C 23/127
See application file for complete search history.

(56) References Cited

U.S. PATENT DOCUMENTS 2,739,395 A * 3/1956 Stratton ..... E02F 9/285 37/453
3,103,752 A * 9/1963 Rockwell ..... E02F 9/28 172/701.3

(Continued)

FOREIGN PATENT DOCUMENTS

DE 202010008045 U1 1/2012
DE 102014007907 A1 12/2014
WO WO-2013030191 A1 * 3/2013 ..... E02F 9/2883

OTHER PUBLICATIONS

English language machine translation of Betek, German Patent Publication No. DE 202010008045 U1, published Jan. 5, 2012 (7 pages) (Year: 2012).*

(Continued)

*Primary Examiner* — Janine M Kreck
*Assistant Examiner* — Michael A Goodwin
(74) *Attorney, Agent, or Firm* — Lucian Wayne Beavers; Patterson Intellectual Property Law, PC

(57) ABSTRACT

The invention relates to a scraper bar (20) for a scraper blade (68) of a road milling machine, having a carrier (10) that comprises a front side and a rearward installation surface (17), the carrier (10) comprising a cutting-element receptacle (13), cutting elements (30) being held, serially arranged along a longitudinal axis (L) extending in a width direction of the carrier (10), on or in the cutting-element receptacle (13), and the cutting elements (30) comprising a cutting edge (35.1) that transitions indirectly or directly into a rake surface (35). In order to improve the working result, provision is made according to the present invention that at least for some of the cutting elements (30), the cutting edge (35.1) is set at least locally not parallel to the longitudinal axis (L).

26 Claims, 6 Drawing Sheets

(56) References Cited

U.S. PATENT DOCUMENTS 3,529,677 A * 9/1970 Stephenson ..... E02F 9/285 172/701.3
4,128,132 A * 12/1978 Moen ..... E02F 9/28 172/747
4,141,160 A * 2/1979 Olson ..... E02F 9/28 172/719
4,187,626 A * 2/1980 Greer ..... E02F 9/285 172/747
5,224,555 A * 7/1993 Bain ..... E02F 3/8152 172/701.3
6,003,617 A * 12/1999 McSweeney ..... E01H 5/061 172/701.1
8,763,281 B2 * 7/2014 Coulombe ..... E01H 5/066 37/266
9,637,875 B2 5/2017 Losen et al.
2003/0188463 A1 * 10/2003 Manway ..... E01H 5/061 37/460
2009/0071042 A1 * 3/2009 Diehl ..... E02F 3/8157 37/460
2009/0145616 A1 * 6/2009 Buxton ..... E02F 3/8152 172/192
2014/0361599 A1 * 12/2014 Losen ..... E01C 23/088 299/39.2
2016/0039030 A1 * 2/2016 Winter ..... E01H 5/061 219/615

OTHER PUBLICATIONS

Office action dated Mar. 9, 2018 in corresponding German patent application Serial No. 10 2017 116 757.9, 8 pages (not prior art).

* cited by examiner

SCRAPER BAR FOR A SCRAPER BLADE OF A ROAD MILLING MACHINE

BACKGROUND OF THE INVENTION

1. Field of the Invention

The invention relates to a scraper bar for the scraper blade of a road milling machine.

2. Description of the Prior Art

Road milling machines are used in road construction. Their purpose is to remove existing road pavements. The road milling machine possesses, for that purpose, a milling drum that is accommodated in a milling drum housing. The milling drum is populated on its surface with a plurality of milling bits. The milling bits are usually installed in upper parts of quick-change bit holder systems. The quick-change bit holder systems possess a lower part that is mounted on the surface of the milling drum. The upper part is joined replaceably to the lower part. The milling bit is mounted in a receptacle of the upper part.

A rotational motion can be imparted to the milling drum in the milling drum housing. When the drum is set onto the roadway surface, the milling bits mill off the roadway pavement. The milled-off material must be transported out of the milling drum housing. An extraction belt is attached for that purpose to the milling drum housing. The milled material is delivered from the milling drum to this extraction belt. The milling drum housing is usually shielded on the side in order to prevent milled material from getting into the surrounding area. Side panels, which extend in the travel direction of the milling drum and are adjustable in height, are usually used for this. The milling drum housing is closed off at the front by a front panel. The scraper blade recited initially is arranged in the region of the rear side of the milling drum housing. The scraper blade is usually embodied in the form of a panel element, and possesses an underside facing toward the roadway surface. One or several scraper bars are arranged in the region of that underside. The scraper blade is adjustable in height via a drive system. The correlation with the roadway surface can thereby be set exactly. As already mentioned above, the milling bits mill off the roadway pavement during milling operation. The result of this is usually a milled pattern in which mutually parallel grooves extending in the travel direction are cut into the roadway surface. Adjacently to the milling drum, the scraper blade having the scraper bars is set onto the surface of the roadway, such that the scraper bars sit on the milled structure. As a result of the advance motion of the road milling machine, the scraper blade is moved along with the road milling machine, and the scraper blade with its scraper bars slides over the milled structure.

The purpose of the scraper blade is on the one hand to prevent milled material from being ejected from the rear side of the milling drum housing. A further purpose is to smooth out any irregularities in the milled structure using the scraper blade, thus producing a milled plane that is as uniform as possible. For example, it is conceivable for a milling bit of the milling drum to sustain damage, in particular to break, during milling operation. This produces a gap in the region of the milling drum. Roadway pavement is then not removed at that gap, so that the desired milled channel in the roadway pavement is not produced but instead an elevation remains in the milled structure. The scraper blade is then capable of breaking up that elevation in order to rework the desired flat milled structure.

Scraper bars are known in the existing art. A cuboidal carrier is usually used for this purpose. The carrier possesses a front working surface and a rearward installation surface. Metal carbide plates are mounted in the region of the lower edge, facing toward the roadway surface, of the working surface. The metal carbide plates are serially arranged and form a lower cutting edge. The scraper bar can be set with the cutting edge onto the roadway surface.

SUMMARY OF THE INVENTION

The object of the invention is to furnish a scraper bar of the kind recited initially with which an improved working result can be achieved.

This object is achieved with a scraper bar that comprises a carrier having a front side and a rearward installation surface. The carrier possesses a cutting-element receptacle on or in which cutting elements are held, serially arranged along a longitudinal axis extending in a width direction of the carrier. The cutting elements comprise a cutting edge that transitions indirectly or directly into a rake surface. At least for some of the cutting elements, according to the present invention the cutting edge is set at an angle, at least locally not parallel to the longitudinal axis.

As previously, the scraper bar can be securely braced with its rearward installation surface against the scraper blade. The scraper bar is then moved during milling operation in an advance direction together with the scraper blade, the advance direction extending transversely to the longitudinal axis. The cutting edges are then consequently also set transversely to the advance direction. If an irregularity in the milled structure then occurs, the cutting edge encounters it obliquely, leading to a better cutting result. In particular, the cutting edge then transfers to the irregularity a force component that is at an angle to the advance direction which corresponds to the setting angle of the cutting edge. What therefore results is a force component acting on the irregularity not only in the advance direction but also transversely to the advance direction. The result is that, in conjunction with the advance motion of the road milling machine, less cutting force is necessary, since the irregularity structures (usually extending in a longitudinal direction) are broken away to the side. This not only reduces the required tractive force but also acts to reduce stress on the cutting elements, thereby extending their service life. The cutting elements are preferably made of a hard material, for example of metal carbide or a ceramic material. They can in particular be joined intermaterially to the carrier; particularly preferably, it is conceivable to use cutting elements made of metal carbide which are soldered to the carrier.

According to a preferred variant embodiment of the invention, provision can be made that at least some of the cutting elements have two cutting edges that are at an angle to one another and are set respectively at an angle to the longitudinal axis. A zigzag-shaped cutting edge can thus be implemented on the scraper bar using cutting elements of simple configuration. Provision can be made in this context in particular that the cutting element comprises two limbs that are at an angle to one another; and that each of the limbs comprises a respective cutting edge. The limbs set with respect to one another can be braced at their rear side on carrier surfaces that are at an angle to one another which corresponds to the setting angle of the limbs. It is thereby possible to position the cutting elements on the carrier in simple and accurately fitting fashion. This has advantages in the context of automated production of the scraper bar.

According to a conceivable inventive alternative, provision can be made that at least some of the cutting elements comprise a secondary cutting edge that extends transversely to the cutting edge or edges of the cutting element. Irregularities that have a comparatively larger extent transversely to the advance direction of the road milling machine can thereby, in particular, be effectively detached from the roadway surface.

A variant of the invention can be such that at least some of the cutting elements comprise abutment surfaces, the cutting elements being serially arranged in the region of their abutment surfaces; and that the cutting edge of the cutting elements extends in the region between the abutment surfaces and preferably is guided at the ends of the cutting edges as far as the abutment surfaces. By way of the abutment surfaces, the cutting elements can be serially arranged in accurately fitting fashion in consideration of production-related tolerances or with interposition of an intermaterial joining layer, for example a solder join. Exact alignment of the cutting elements with respect to the carrier thereby becomes easily possible. If the cutting edges are guided as far as the abutment surfaces it is then possible to configure, in a longitudinal direction, an uninterrupted or approximately uninterrupted continuous cutting edge on the scraper bar.

A further variant of the invention can be characterized in that at least some of the cutting elements comprise two rake surfaces that adjoin one another indirectly or directly at a respective cutting edge; and that the rake surfaces are at a roof-shaped angle to one another. This feature, too, results in an improved cutting effect for the scraper bar. The material that is removed can be discharged on both sides via the two rake surfaces.

According to the present invention, the cutting elements can be serially arranged in the cutting-element receptacle in such a way that the cutting edges and/or the rake surfaces form a wave-shaped, zigzag-shaped, or sawtooth-shaped structure. Wave-shaped and zigzag-shaped structures result in a cutting edge having a wear-optimized configuration. A sawtooth-shaped structure forms a breakage-resistant cutting edge.

It has been found that particularly good cutting results can be achieved according to the present invention when provision is made that the cutting edges are set in the angle range between 2° and 28°. Particularly good results when processing road pavements made of concrete can be achieved when the edges are set with respect to the longitudinal axis in the angle range between 10° and 20°.

A further improvement in wear behavior for the scraper bar can be achieved by the fact that the carrier comprises at the bottom, adjacently to the cutting elements (30), an adjoining surface that extends in set-back fashion with respect to the cutting edges in order to form a flank surface; and that one or more skid runners made of a hard material are arranged in the region of the adjoining surface. In the interest of simple manufacture, provision can be made in this context in particular that one or several receptacles, in which the skid runner is/are at least partly received, is/are recessed into the adjoining surface. It is then furthermore also possible, for example, to configure the receptacles in such a way that the skid runners are braced in positively engaging fashion oppositely to the advance direction so that a strength-optimized conformation can be achieved.

One conceivable variant of the invention is such that the cutting-element receptacle of the carrier comprises several elevations that engage into depressions of the cutting elements; or that the cutting-element receptacle of the carrier comprises several depressions that engage into elevations of the cutting elements. The cutting element can be positioned and aligned at the elevation or depression for installation purposes. Provision can be made here in particular that the cutting-element receptacle is assembled at least locally from sub-receptacles; and that each sub-receptacle comprises at least one elevation or depression. For example, one cutting element can be inserted in accurately fitting fashion in each sub-receptacle. In addition, a positively engaging join can be produced, by way of the elevations or depressions, between the cutting element and the carrier transversely to the longitudinal axis or transversely to the advance direction of the road milling machine; this results in improved bracing. Alternatively, however, it is also conceivable for the cutting-element receptacle to comprise a flat placement surface that extends along the longitudinal axis; and for the cutting elements to be braced on that placement surface through the intermediary of a joining material, in particular a solder material.

In order to allow the scraper bar to be aligned precisely on the scraper blade in simple fashion, provision can be made that the carrier comprises an extension that projects rearward beyond the rear-side installation surface, such that the installation surface and a support surface of the extension enclose an angle. The scraper bar can be positioned and aligned, with its support surface and the rearward installation surface, on corresponding counterpart surfaces of the scraper blade. The rearward extension furthermore offers the possibility of receiving wear protection elements. For example, the aforementioned skid runners can be used here, and have sufficient room. It is also conceivable for other wear protection elements made of hard material to be integrated or inserted into the underside, facing toward the roadway pavement, of the rearward extension.

BRIEF DESCRIPTION OF THE DRAWINGS

The invention will be explained in further detail below with reference to exemplifying embodiments depicted in the drawings, in which.

DETAILED DESCRIPTION

Figure 1:
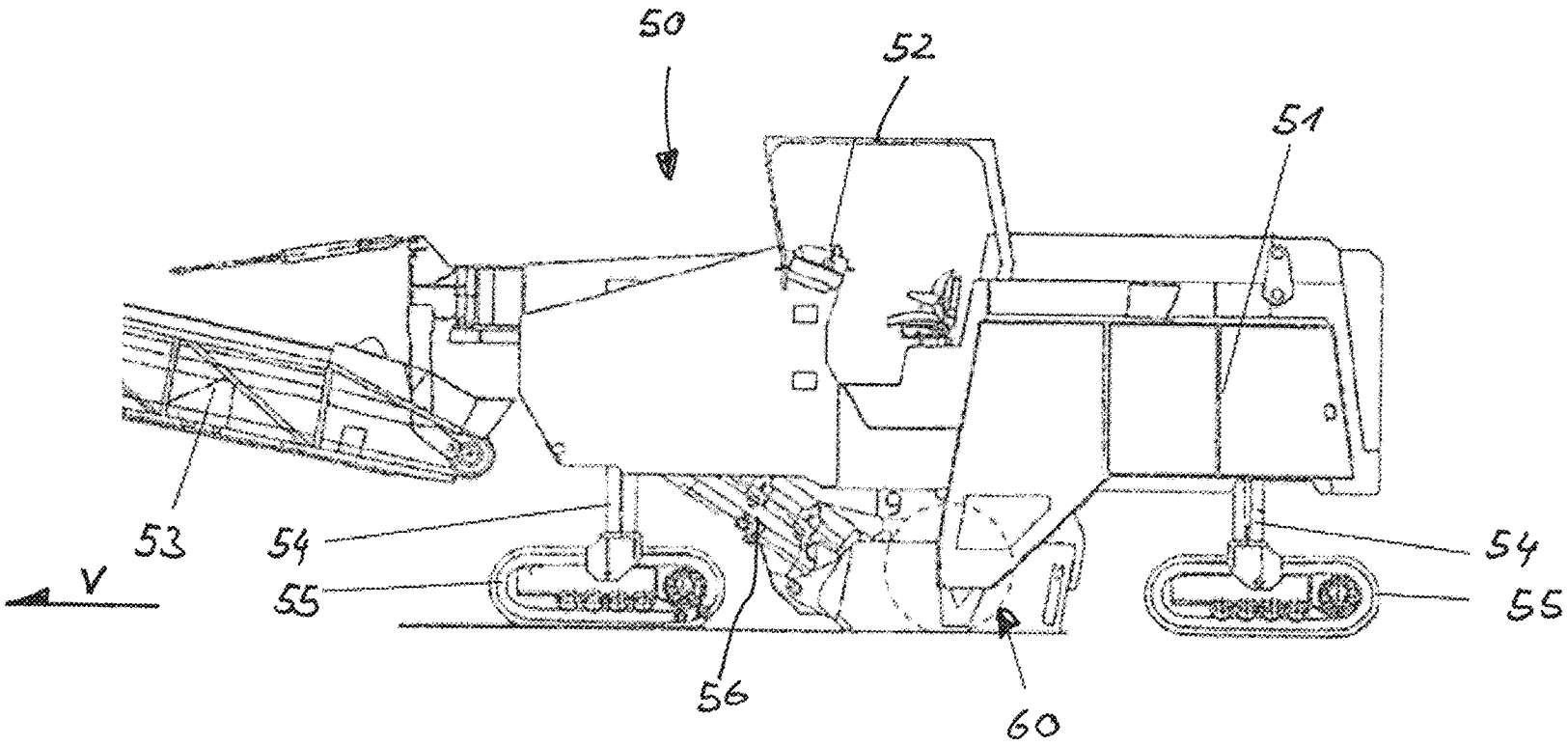
FIG. 1 is a side view of a road milling machine.

FIG. 1 is a side view of a road milling machine 50. Road milling machine 50 possesses a chassis 51 that is carried by four propelling units 55. Two front propelling units 55 and two rear propelling units 55 are provided. Each propelling unit 55 is coupled to chassis 51 via a lifting column 54. Chassis 51 can be displaced in height with respect to propelling units 55 via lifting columns 54. Propelling units 55 are embodied in the present case as crawler track units. Chassis 51 furthermore carries a control cabin 52 for a machine operator. Control elements for road milling machine 50 are arranged here so that the machine driver can operate and drive road milling machine 50. A milling unit 60 is arranged between propelling units 55. A receiving belt 56 is associated with milling unit 60. The material milled off by milling unit 60 can be transported away via the receiving belt. Adjacently to receiving belt 56, the milled-off material falls onto a conveyor device 53. Conveyor device 53 can encompass a circulating conveyor belt. The milled material is loaded onto a truck by means of conveyor device 53.

Figure 2:
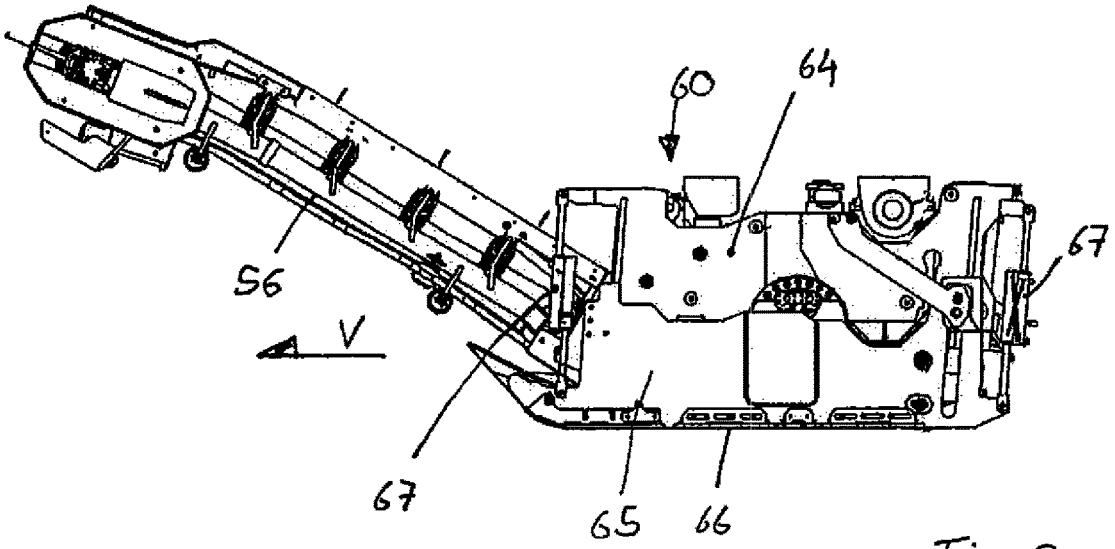
FIG. 2 is a side view of a milling unit of the road milling machine according to FIG. 1.
Figure 3:
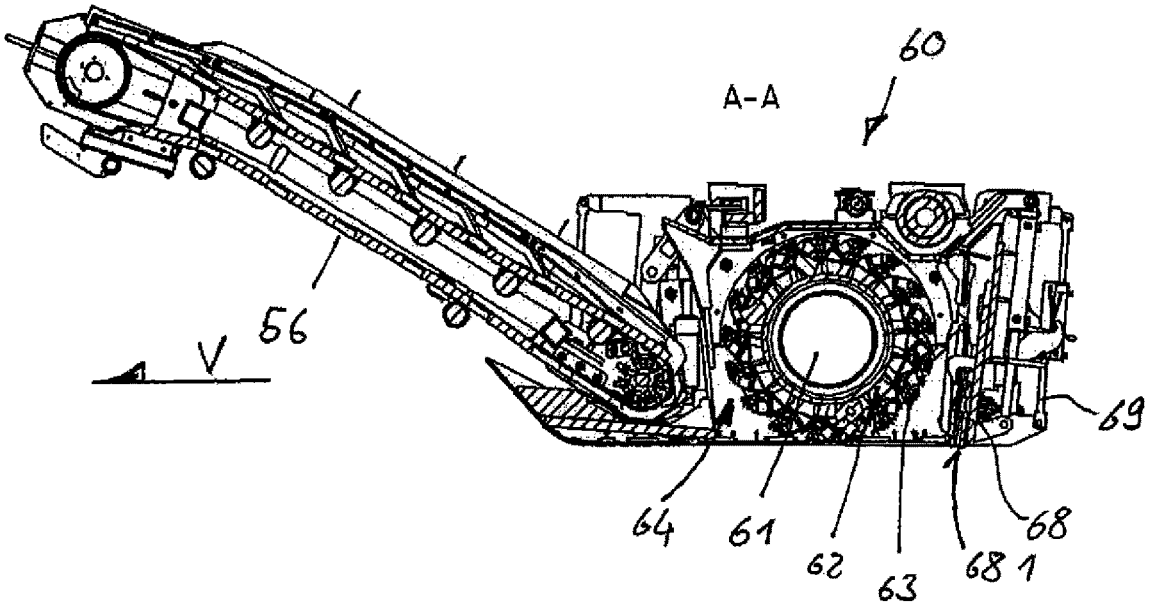
FIG. 3 is a vertical section of the milling unit according to FIG. 2.

The configuration of milling unit 60 is depicted in more detail in FIGS. 2 and 3. As these drawings show, milling unit 60 comprises a milling drum 61. Milling drum 61 possesses a milling drum tube. Bit holders or quick-change bit holder systems 62 are mounted on the outer surface of the milling drum tube. When quick-change bit holder systems 62 shown in FIGS. 2 and 3 are used, a lower part of the quick-change bit holder system is mounted on the surface of the milling drum tube, for example bolted fixedly thereonto. An upper part, for example a bit holder, can be joined replaceably to the lower part. The bit holder possesses a bit receptacle. A milling bit 63 can be mounted replaceably in the bit receptacle. Milling drum 61 described above can be received rotatably in a milling drum housing 64. Milling drum 61 is driven by a drive unit of road milling machine 50.

Milling drum housing 64 preferably surrounds milling drum 61 on all sides with the exception of its lower side. Milling unit 60 accordingly possesses two side panels 65 that are arranged in the region of the longitudinal ends of milling drum 61. These side panels 65 extend in the travel direction of road milling machine 50, which corresponds to the advance direction indicated in the drawings. Side panels 65 can be displaced as to height, i.e. vertically, separately from one another via a respective displacement mechanism 67. Side panels 65 comprise runners 66 at the bottom. Side panels 65 are set, with these runners 66, on the surface of the roadway during milling operation.

Arranged in front of milling drum 61 in the travel direction is a front panel of milling drum housing 64, which panel comprises a passage. A physical connection between receiving belt 56 and milling drum 61 is created via the passage. Milling drum housing 64 is closed off at the top by a top panel. A rear panel is arranged at the rear. A scraper blade 68 is arranged at the lower end of the rear panel. Scraper blade 68 comprises a lower horizontal edge that proceeds, in FIG. 3, in a depth direction into the image plane.

During milling operation, milling drum 61 is set onto the surface of the roadway that is to be worked. This is done by displacing lifting columns 54; milling drum 61 then rests with its lower side on the roadway surface. When a rotational motion is then imparted to milling drum 61, it mills off the surface of the roadway using milling bits 63. Quick-change bit holder systems 62 are positioned in the form of clearing and loading helices on the surface of milling drum 61. The milled material is transported by these clearing and loading helices to a predetermined location on milling drum 61, for example to the center of the milling drum, where ejectors of milling drum 61 are arranged. These throw the milled material onto receiving belt 56 so that it can be transported out of the working region. Scraper blade 68 does not, however, sit directly with its lower edge 68.1 on the roadway surface; instead, scraper bars 20—different variants of which are shown in FIGS. 4 to 14—are installed there. Those Figures will be discussed below.

Figure 4:
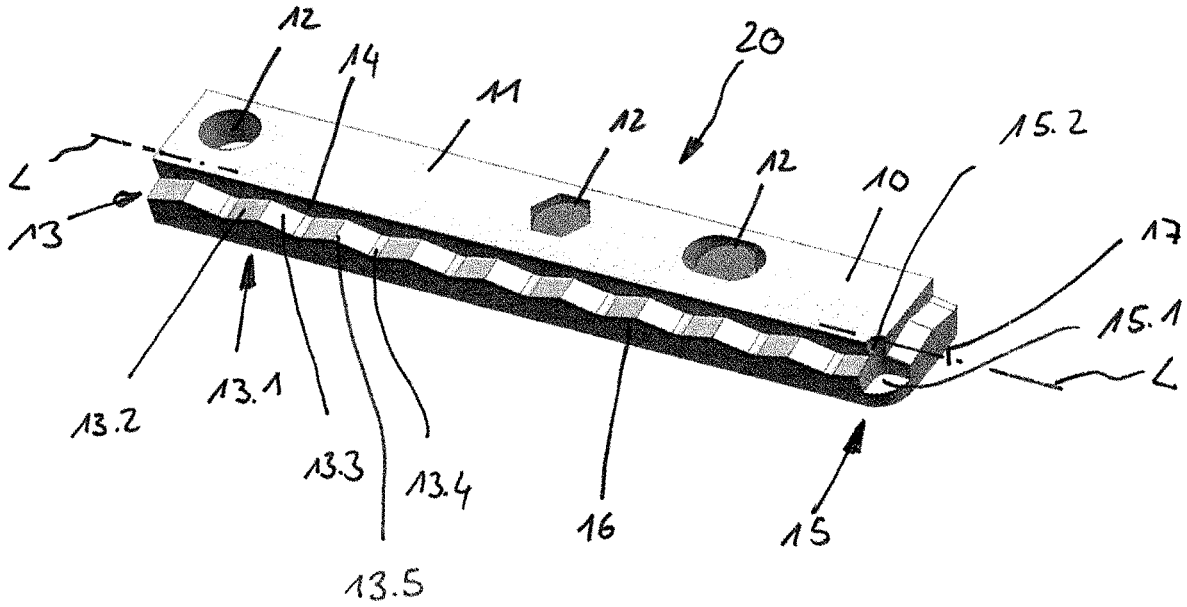
FIGS. 4 and 5 are perspective depictions of a first exemplifying embodiment of a scraper bar.
Figure 5:
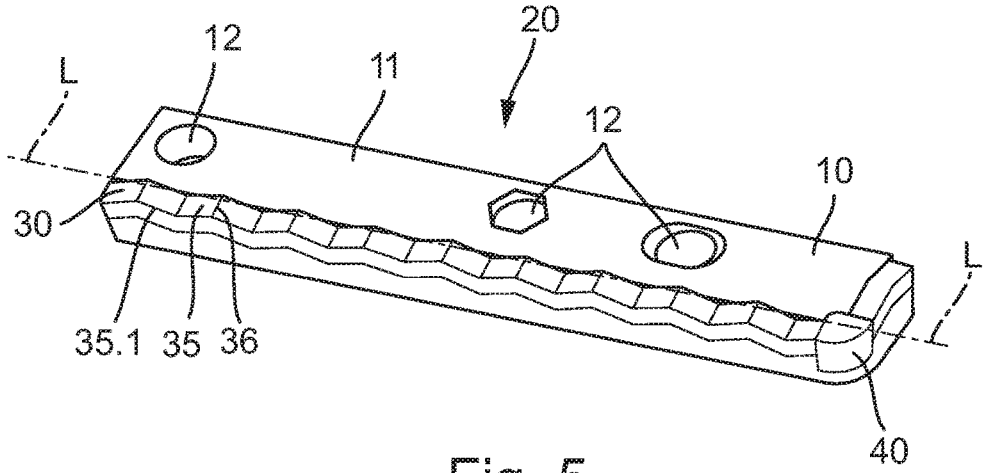

Scraper bars 20 have a carrier 10. The latter can be constituted, for example, from a steel material. Carrier 10 can be embodied, for example, as a forged part as shown in FIGS. 4 and 5. It is also possible for carrier 10 to be embodied as a milled part. Cutting elements 30 of scraper bar 20 are mounted on carrier 10. Cutting elements 30 are made of a hard material. It is conceivable to use metal carbide or ceramic as a hard material. Cutting elements 30 are preferably joined intermaterially to carrier 10; for example, it is conceivable for cutting elements 30 to be soldered to carrier 10. It is furthermore advantageous if, in addition or alternatively to a selected type of join, for example an intermaterial join, cutting elements 30 are also joined in positively engaging fashion to carrier 10.

FIG. 4 shows, by way of example, a carrier 10. The latter comprises at the front a scraper surface 11, and at the rear an installation surface 17. Scraper surface 11 can be embodied parallel to installation surface 17. As FIG. 4 shows, one or several bolt receptacles 12 can be provided in the carrier. These bolt receptacles 12 penetrate through both scraper surface 11 and installation surface 17, and are thus embodied as through holes. A cutting-element receptacle 13 is arranged in the region of the lower horizontal edge of carrier 10. Cutting-element receptacle 13 is arranged with a setback to the rear with respect to scraper surface 11. Carrier 10 can have a cuboidal structure, having a longitudinal axis L that extends in a width direction. Carrier 10 has a component height, perpendicular to longitudinal axis L, that is considerably less than the component width. Carrier 10 furthermore has a component depth that once again is less than the component height. A cutting-element receptacle 13 can extend along longitudinal axis L.

As also shown in FIG. 4, cutting-element receptacle 13 is embodied in segmented fashion. It accordingly comprises sub-receptacles 13.1. Sub-receptacles 13.1 each have support surfaces 13.2, 13.3. These support surfaces 13.2, 13.3 are arranged at an angle to one another. Support surfaces 13.2, 13.3 thus form elevations 13.5 that face toward the region of scraper surface 11. Facing away from scraper surface 11, support surfaces 13.2, 13.3 comprise transitions 13.4 that are embodied in set-back fashion. Cutting-element receptacle 13 also comprises a wall 14. The latter can be arranged, for example, perpendicularly to scraper surface 11 or at any other angle with respect to said scraper surface 11. In the case of scraper bar 20 shown in FIGS. 4 and 5, a corner receptacle 15 is provided at one of the longitudinal ends of cutting-element receptacle 13. The corner receptacle forms a support segment 15.1 that can be embodied in the form of a support surface. Corner receptacle 15 furthermore comprises connecting surfaces 15.2. Adjacently to corner receptacle 15, cutting-element receptacle 13 continues in the component height direction. In the depth direction, an adjoining surface 16 adjoins cutting-element receptacle 13 below cutting-element receptacle 13. This surface can extend perpendicularly to scraper surface 11 or to installation surface 17. Advantageously, adjoining surface 16 can also extend at an angle of more than 270° with respect to scraper surface 11.

Figure 7:
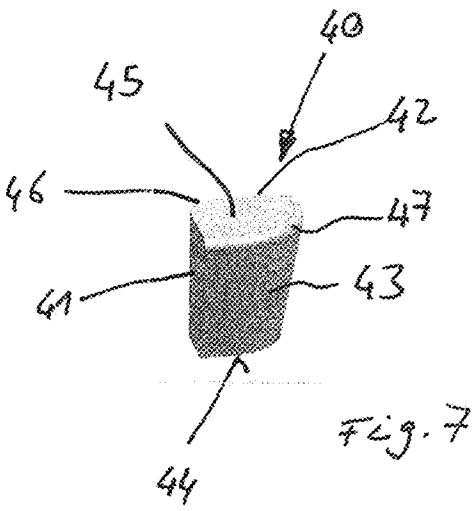
FIG. 7 is a perspective depiction of a corner cutting element for the scraper bar according to FIGS. 4 and 5.
Figure 6:
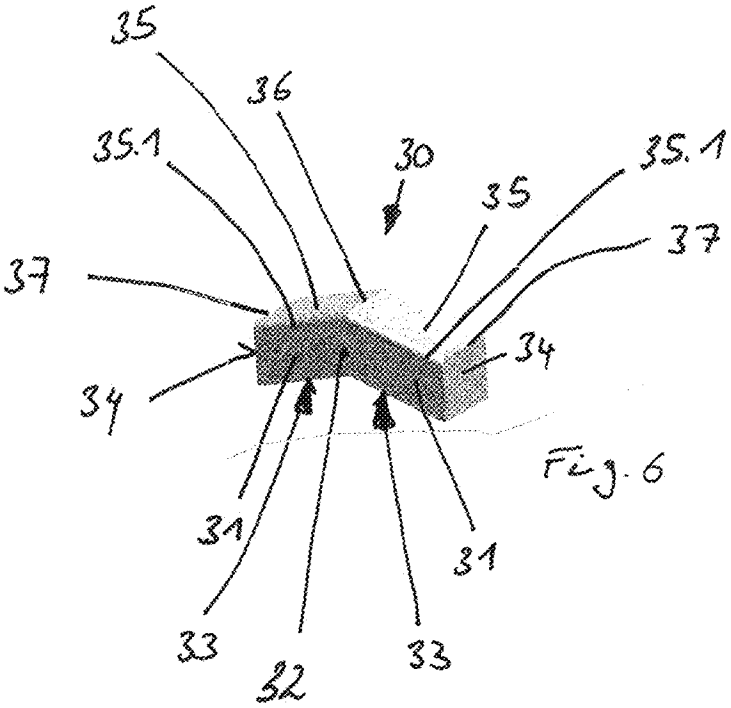
FIG. 6 is a perspective depiction of a cutting element of the scraper bar according to FIGS. 4 and 5.

Be it noted at this juncture that the configuration features of carrier 10 explained above with reference to FIG. 4 are intended to apply not only to the embodiment according to FIGS. 4 to 7 of a scraper bar 20. These statements are instead intended to apply also to the other variant embodiments of scraper bars 20 described below, or to other scraper bars 20 according to the present invention.

Cutting elements 30 can be mounted on cutting-element receptacle 13. Cutting elements 30 are depicted in more detail in FIG. 6. As is evident from that depiction, cutting elements 30 have two limbs 33 that are at an angle to one another. Limbs 33 terminate at the bottom in flank surfaces 31. A secondary cutting edge 36 is arranged at the front in connecting region 32 in which limbs 33 meet one another. This secondary cutting edge 36 connects two rake surfaces 35 that are at an angle to one another. Rake surfaces 35 form a roof-shaped geometry. Cutting edges 35.1 are formed in the transition region between flank surfaces 31 and rake surfaces 35. Cutting edges 35.1 can be arranged so that they are guided as far as connecting region 32. Cutting edges 35.1 are preferably embodied so that they meet one another in the connecting region. It is also conceivable for cutting edges 35.1 that meet one another to meet at secondary cutting edge 36. As is further evident from FIG. 6, rake surfaces 35 transition via segments 37 into abutment surfaces 34. The two oppositely located abutment surfaces 34 are preferably parallel to one another.

Cutting elements 30 can be mounted on sub-receptacles 13.1 of cutting-element receptacle 13 through the intermediary of an intermaterial join, for example solder material or adhesive material. For that purpose, cutting elements 30 are placed with their limbs 33 onto support surfaces 13.2, 13.3 of cutting-element receptacle 13. Those sides of cutting element 30 which are located opposite flank surfaces 31 are pushed against wall 14. Exact positioning and alignment of cutting elements 30 is thereby achieved. Flank surface 31 preferably transitions flush into adjoining surface 16. Cutting elements 30 are serially arranged along longitudinal axis L, and abutment surfaces 34 of the adjacent cutting elements 30 abut against one another. Abutment surfaces 34 do not need to meet one another directly. It is instead preferably also conceivable for intermaterial joins, for example a solder join or an adhesive join, to be arranged between abutment surfaces 34. A corner cutting element 40 can be inserted into corner receptacle 15. Corner cutting element 40 is shown in FIG. 7. As is evident from this depiction, corner cutting element 40 comprises abutment surfaces 41, 42 at an angle to one another. A placement surface 44 is provided on the bottom, and a rake surface 45 oppositely from it. A connecting surface 46 is provided in the region in which the two abutment surfaces 41, 42, located at an angle to one another, meet one another. Connecting surface 46 can also merely comprise a radius. Oppositely from connecting surface 46, deflection surface 45 possesses a cutting edge 47. This cutting edge 47 is configured in a curved shape in the present instance. A flank surface 43 adjoins cutting edge 47. As in the exemplifying embodiment shown, that flank surface 43 can extend from cutting edge 47 as far as placement surface 44. It is also conceivable for flank surface 43 to extend only over a sub-region. Flank surface 43 can preferably be embodied as a convexly curved wall, as in the exemplifying embodiment shown.

FIG. 5 shows the completely installed scraper bar 20. As is evident from this depiction, the cutting elements form a zigzag-shaped cutting edge in the region of the underside of scraper bar 20. With a corresponding conformation of cutting elements 30 it would also be possible to implement a wave-shaped cutting edge if cutting edges 35.1 of cutting element 30 were not set at an angle to one another but instead were arranged in a wave shape. In this case it is recommended that rake surfaces 35 also be arranged in a wave shape with respect to one another.

Figure 8:
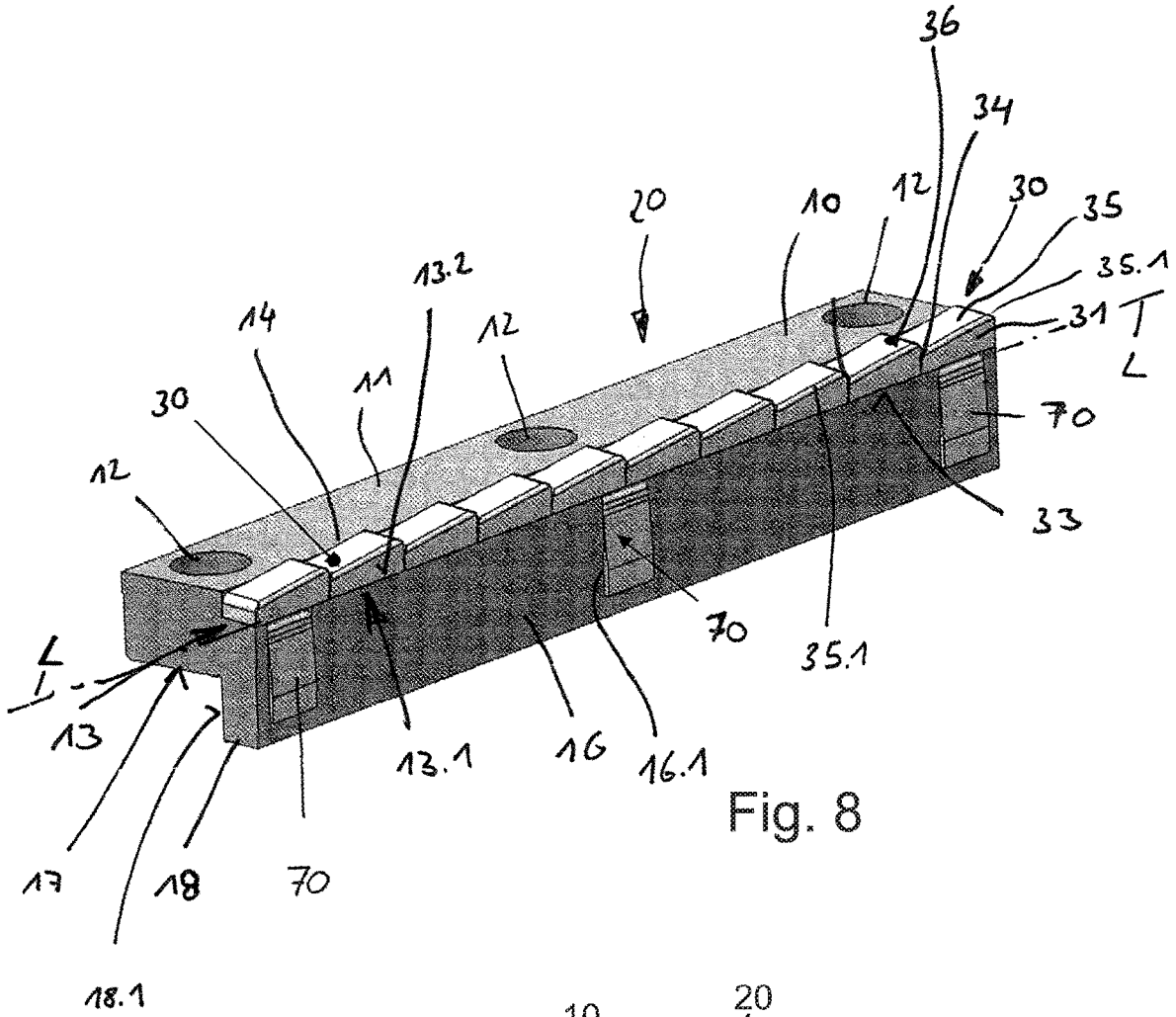
FIG. 8 is a perspective view from below of a second variant embodiment of a scraper bar.
Figure 9:
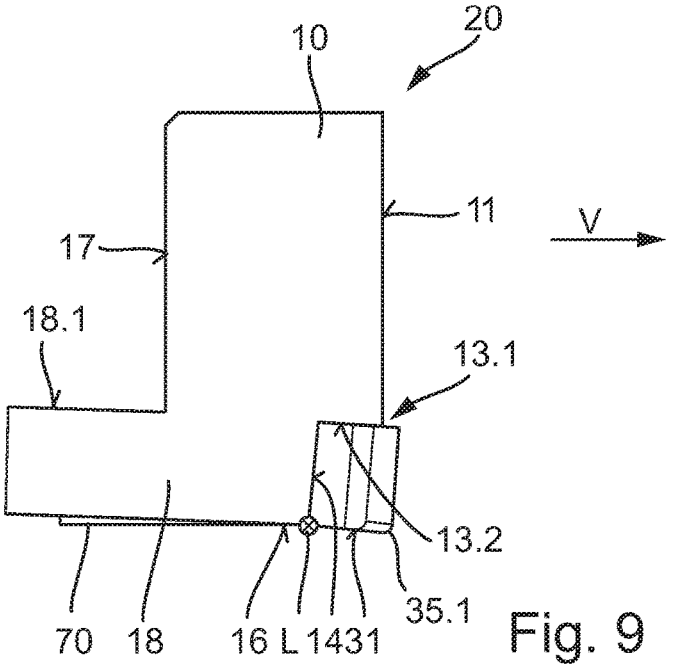
FIG. 9 is a side view of the scraper bar according to FIG. 8.

FIGS. 8 and 9 show a further variant embodiment of a scraper bar 20 in which a sawtooth-shaped cutting edge is implemented. As FIG. 8 shows, in contrast to the configuration according to FIGS. 4 to 7, a segmented cutting-element receptacle 13 having sub-receptacles 13.1 is not used. What is present here instead is a cutting-element receptacle 13 that is continuous along longitudinal axis L. It is conceivable here as well, of course, to implement a segmented cutting-element receptacle 13 having sub-receptacles 13.1. Cutting elements 30 are serially arranged in cutting-element receptacle 13. Cutting elements 30 again form a bottom-side flank surface 31 that transitions via a cutting edge 35.1 into rake surfaces 35. Oppositely from flank surface 31, cutting element 30 again possesses an abutting surface for abutment against a wall 14 of cutting-element receptacle 13. Cutting elements 30 form, at oppositely located sides, abutment surfaces 34 by way of which they are serially arranged. Cutting edges 35.1 of cutting elements 30 do not extend parallel to longitudinal axis L but instead are set at an angle with respect thereto.

With the variant embodiment according to FIGS. 8 to 9, a rear-side extension 18 is provided on carrier 10. Extension 18 projects beyond installation surface 17 and is joined in one piece to carrier 10. Extension 18 forms a support surface 18.1. Installation surface 17 and support surface 18.1 enclose an angle. In the region of the underside, carrier 10 possesses receptacles 16.1 that are recessed into the underside of carrier 10. Skid runners 70 made of hard material are inserted into receptacle 16.1. Metal carbide, ceramic, or another hard substance can again be used as a hard material. Skid runners 70 are preferably held intermaterially in receptacles 16. They are arranged so that they project a little way beyond the underside of adjoining surface 16, as shown in FIG. 9. Skid runners 70 thus provide wear protection for the underside of carrier 10. The use of a rearward extension 18 and of the above-described skid runners 70 is not limited to the present exemplifying embodiment. These conformations can instead also be provided, individually or in combination, in the context of other exemplifying embodiments and in particular as desired in conjunction with the invention.

As FIG. 9 further shows, cutting elements 30 are inserted into cutting-element receptacle 13.1 in such a way that flank surface 31 is embodied with an inclination with respect to the bottom horizontal line extending parallel to the advance direction. In particular, the bottom horizontal line and flank surface 31 enclose an acute angle. This feature as well can be utilized in all embodiments of the invention.

Figure 10:
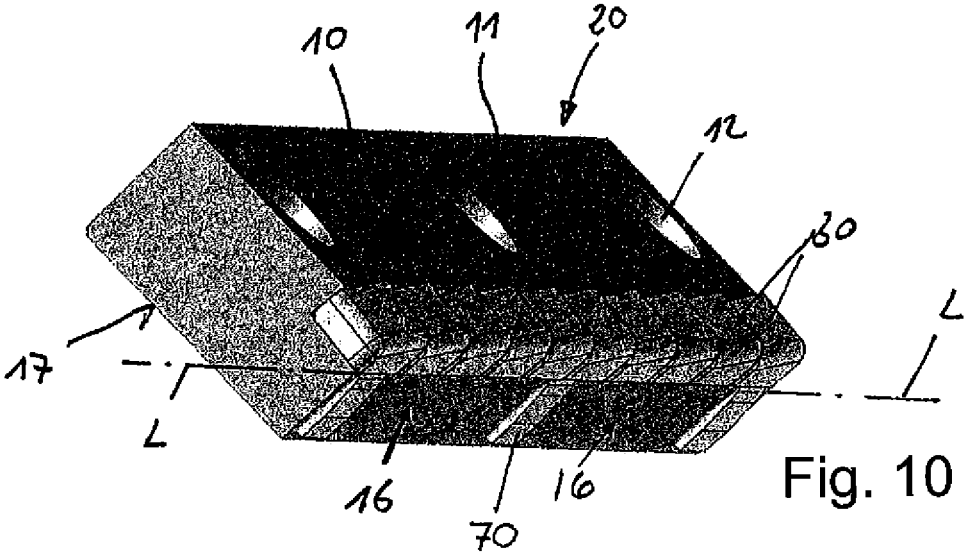
FIG. 10 is a perspective view of a third variant embodiment of a scraper bar.
Figure 11:
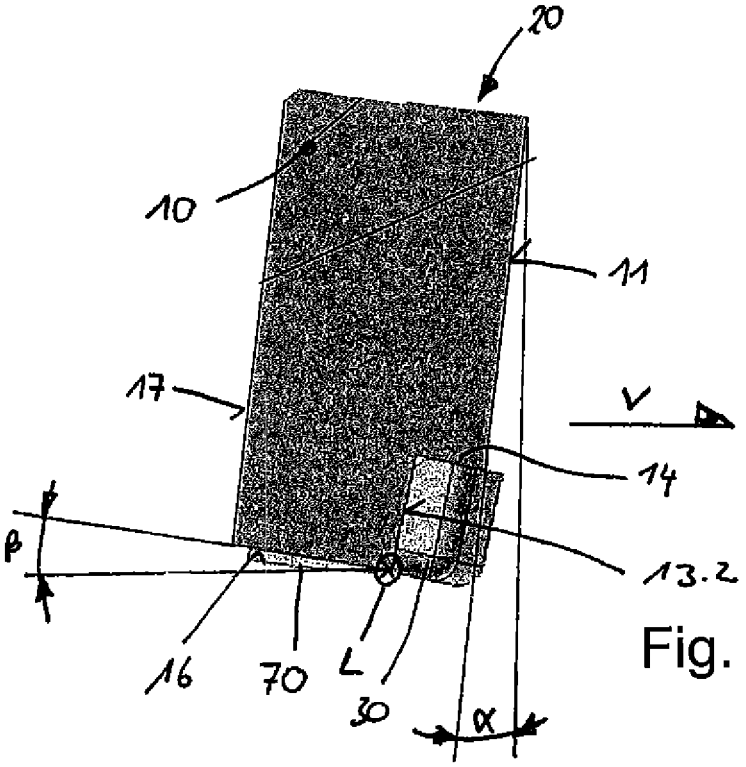
FIG. 11 is a side view of the scraper bar according to FIG. 10.
Figure 12:
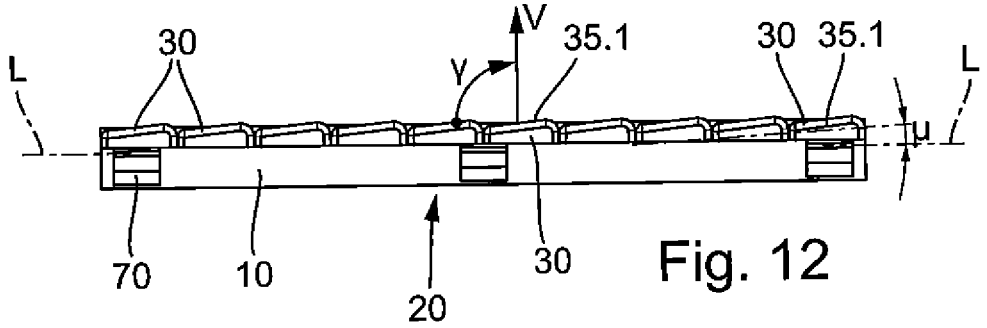
FIG. 12 is a view from below of the scraper bar according to FIGS. 10 and 11.

FIGS. 10 to 12 show an exemplifying embodiment of the invention which is embodied analogously to the exemplifying embodiment according to FIGS. 8 and 9, so that reference may be made to the statements above. The only difference between the two embodiments is that a rear-side extension 18 is not utilized in the context of scraper bar 20 according to FIGS. 10 to 12. As FIG. 11 shows and as has been described above with reference to FIGS. 8 and 9, the bottom-side adjoining surface 16 is inclined with respect to the bottom horizontal line (angle $\beta$). When scraper bar 20 is in the installed position, the front-side scraper surface 11 is slightly tilted with respect to the vertical plane which is perpendicular to the advance direction (angle $\alpha$). It is apparent from FIG. 12 that cutting edges 35.1 of cutting elements 30 are, in accordance with the invention, at an angle ($\mu$) with respect to longitudinal axis L. It is also evident from FIG. 12 that in the installed position, scraper bar 20 is oriented so that advance direction V extends transversely to longitudinal extent L. Cutting edges 35.1 of cutting elements 30 are accordingly also set with respect to the advance direction at an angle γ which is greater than 90°.

Skid runners 70 that are inserted into the underside of carrier 10 are also used in the exemplifying embodiment according to FIGS. 10 to 12.

Scraper bars 20 described above can be installed on lower edge 68.1 of a scraper blade 68, as has been described above. Several scraper bars 20 are installed next to one another in order to populate lower edge 68.1 at least in part. It is conceivable for physically identical scraper bars 20 always to be installed next to one another on scraper blade 68. It is also possible for scraper bars 20 having corner cutting elements 40 to be installed at the longitudinal ends of scraper blade 68. FIGS. 4 to 7 show an exemplifying embodiment of an end-located scraper bar 20 of this kind. The step that occurs in the milled pattern and is produced as a consequence of milling drum 61 is also reworked with such end-located scraper bars 20, and corner cutting elements 40 ensure a clean and exact termination. It is therefore conceivable in the context of the invention to utilize a scraper blade 68 in which scraper bars 20 are serially arranged, the two last scraper bars 20 of that series comprising a corner cutting element 40. It is also conceivable, in the context of those two, or one, end-located scraper bar(s), for at least one cutting element 30 to adjoin corner cutting element 40 on both sides, as shown e.g. by FIG. 5.

The invention claimed is:

1. A scraper bar for a scraper blade of a road milling machine, the scraper bar comprising:

a carrier including a front side, a rear-side installation surface, and a cutting-element receptacle; and a plurality of cutting elements serially arranged along a longitudinal axis extending in a width direction of the carrier on the cutting-element receptacle, each of the cutting elements including a cutting edge that transitions indirectly or directly into a rake surface;

wherein the cutting edge of at least some of the cutting elements extends along the width direction and is at least partially set at an inclination angle not parallel to the longitudinal axis.

2. The scraper bar of claim 1, wherein:

at least some of the cutting elements include two of the cutting edges, the two cutting edges being at an angle to one another, and the two cutting edges each being at least partially set at an inclination angle not parallel to the longitudinal axis.

3. The scraper bar of claim 1, wherein:

at least some of the cutting elements include two limbs at an angle to one another, each of the two limbs including one of the cutting edges at least partially set at an inclination angle not parallel to the longitudinal axis.

4. The scraper bar of claim 1, wherein:

at least some of the cutting elements include a secondary cutting edge extending transversely to the cutting edge.

5. The scraper bar of claim 1, wherein:

at least some of the cutting elements include abutment surfaces, the serial arrangement of the cutting elements being provided by abutment of the abutment surfaces of adjacent cutting elements with one another; and the cutting edge of each of the cutting elements extends in a region between the abutment surfaces of the respective cutting element.

6. The scraper bar of claim 5, wherein:

the cutting edge of each of the cutting elements extends to the abutment surfaces of the respective cutting element.

7. The scraper bar of claim 1, wherein:

at least some of the cutting elements include two of the rake surfaces, the two rake surfaces adjoining one another indirectly or directly at a secondary cutting edge of the respective cutting element; and the two rake surfaces are at a roof-shaped angle to one another.

8. The scraper bar of claim 1, wherein:

the plurality of cutting elements serially arranged along the longitudinal axis are arranged such that the cutting edges form a zigzag-shaped structure.

9. The scraper bar of claim 1, wherein:

the plurality of cutting elements serially arranged along the longitudinal axis are arranged such that the cutting edges form a sawtooth-shaped structure.

10. The scraper bar of claim 1, wherein:

the inclination angle of the cutting edges is in an angle range between 2 degrees and 28 degrees with respect to the longitudinal axis.

11. The scraper bar of claim 10, wherein:

the angle range is between 10 degrees and 20 degrees.

12. The scraper bar of claim 1, wherein:

the carrier includes a bottom surface adjacent to the cutting elements, the bottom surface extending rearward relative to the cutting edges; and the scraper bar includes one or more skid runners arranged on the bottom surface, the skid runners being made of a hard material harder than the carrier.

13. The scraper bar of claim 12, wherein:

the bottom surface of the carrier has one or more receptacles recessed into the bottom surface, and each of the one or more skid runners is at least partly received in a respective one of the receptacles.

14. The scraper bar of claim 12, wherein:

the carrier is configured such that when the scraper bar is installed on a scraper blade of a milling machine, the bottom surface of the carrier is inclined rearwardly upward with respect to a horizontal line.

15. The scraper bar of claim 1, wherein:

the carrier includes an extension projecting rearward beyond the rear-side installation surface, the extension including a support surface such that the rear-side installation surface and the support surface enclose an angle.

16. The scraper bar of claim 1, wherein:

the cutting-element receptacle includes a plurality of elevations, and at least some of the cutting elements include a depression, each of the elevations engaging a respective one of the depressions.

17. The scraper bar of claim 16, wherein:

the cutting-element receptacle is assembled from a plurality of sub-receptacles, each sub-receptacle including at least one of the elevations.

18. The scraper bar of claim 1, wherein:

the cutting-element receptacle includes a plurality of depressions, and at least some of the cutting elements include an elevation, each of the elevations engaging a respective one of the depressions.

19. The scraper bar of claim 18, wherein:

the cutting-element receptacle is assembled from a plurality of sub-receptacles, each sub-receptacle including at least one of the depressions.

20. The scraper bar of claim 1, wherein:

the cutting-element receptacle includes a flat placement surface extending along the longitudinal axis; and the cutting elements are each joined to the placement surface with a solder material.

21. The scraper bar of claim 1, wherein:

the carrier has a width parallel to the longitudinal axis, a height perpendicular to the longitudinal axis, and a depth perpendicular to the width and the height, wherein the width is greater than the height and the width is greater than the depth.

22. The scraper bar of claim 1, wherein:

the carrier includes receptacles defined through the rear-side installation surface for receiving fasteners for attaching the carrier to a scraper blade.

23. The scraper bar of claim 22, wherein:

the front side of the carrier includes a scraper surface extending generally parallel to the rear-side installation surface; and the receptacles penetrate the scraper surface and the rear-side installation surface.

24. The scraper bar of claim 1, wherein:

at least some of the cutting edges of the cutting elements lie in one plane.

25. The scraper bar of claim 1, wherein:

at least some of the rake surfaces of the cutting elements are arranged parallel to one another.

26. The scraper bar of claim 1, in combination with:

a height-adjustable scraper blade for a road milling machine; and a plurality of additional scraper bars, the scraper bars all being mounted on an underside of the scraper blade.

* * * * *